US005435550A

United States Patent [19]

You

[11] Patent Number: 5,435,550

[45] Date of Patent: Jul. 25, 1995

[54] GAME RACKET

[76] Inventor: Chin-San You, No. 6, Lane 477, Sec. 2, Feng-Shyn Rd., Feng Yuan City, Taichung Hsien, Taiwan

[21] Appl. No.: 377,983

[22] Filed: Jan. 25, 1995

[51] Int. Cl.[6] ..... A63B 49/14

[52] U.S. Cl. ..... 273/73 D

[58] Field of Search ..... 273/73 R, 73 C, 73 D, 273/73 G

[56] References Cited

U.S. PATENT DOCUMENTS

| | | | |
|---|---|---|---|
| 1,523,865 | 1/1925 | Craig | 273/73 D |
| 3,884,467 | 5/1975 | Sommer | 273/73 D |
| 4,462,592 | 7/1984 | Legger et al. | 273/73 D |
| 4,591,165 | 5/1986 | Sines et al. | 273/73 D |
| 4,681,319 | 7/1987 | Zilinskas | 273/73 D |
| 5,251,895 | 10/1993 | Darling | 273/73 D |
| 5,257,781 | 11/1993 | Sines et al. | 273/73 D |
| 5,342,044 | 8/1994 | You | 273/73 D |
| 5,368,297 | 11/1994 | Liu | 273/73 D |

FOREIGN PATENT DOCUMENTS

| | | | |
|---|---|---|---|
| 3806038 | 9/1989 | Germany | 273/73 D |

*Primary Examiner*—William E. Stoll

*Attorney, Agent, or Firm*—Browdy and Neimark

[57] ABSTRACT

A game racket comprises a head frame provided with a plurality of first string holes and second string holes for stringing the game racket head. The head frame is provided in the outer surface thereof with a plurality of string protecting casings, each of which has a body portion and a plurality of guide tubes which can be inserted into the corresponding first string holes or second string holes. Some of the string protecting casings are provided with a locating hole which is located centrally between the two guide tubes. The head frame is further provided with a plurality of guide blocks located respectively at the outer side of the string protecting casing and between two adjoining guide tubes. The guide blocks are provided respectively with a locating column corresponding in location to and engageable securely with the locating hole of the string protecting casing.

10 Claims, 3 Drawing Sheets

GAME RACKET

FIELD OF THE INVENTION

The present invention relates generally to a game racket, and more particularly to an improvement of a game racket disclosed in the U.S. Pat. No. 5,342,044.

BACKGROUND OF THE INVENTION

In order to protect the string of a game racket from an excessive friction, the string holes of the game racket are provided with the string protecting casing of a nylon material. The string is generally made of a nylon material. As a result, the string can hardly slide in the string protecting casing when the string protecting casing is exerted on by a great pressure, thereby undermining the shock absorbing effect and the ball controlling effect of the game racket.

The U.S. Pat. Nos. 4,591,165 and 4,930,782 disclose respectively a game racket having a head frame provided on the outer edge thereof with a plurality of oval blocks. The string is wound such that the string passes the outer edge of each of the oval blocks before entering the inner side of the racket head frame. As a result, the strung surface of the game racket head is therefore capable of mitigating the impact of a ball making contact with the strung surface.

Such oval blocks as described above are generally defective in design in that the oval blocks are vulnerable to becoming detached from the head frame when the head frame or the strung surface is impacted severely, and that the oval blocks can not be effectively located when the game racket head is strung or when the string is broken.

SUMMARY OF THE INVENTION

It is therefore the primary objective of the present invention to provide a game racket with a head frame having on the outer edge thereof a plurality of rigid guide blocks enabling the string to attach slidably to the outer edge of the head frame.

It is another objective of the present invention to provide a game racket with a head frame having a plurality of rigid guide blocks, each of which is secured to the string protecting casing of the game racket head for improving the sliding of the string on the outer edge of the head frame.

It is still another objective of the present invention to provide a game racket with a head frame having a plurality of rigid blocks, each of which is provided with a tubular portion secured to the string protecting casing or the string hole for preventing the string from being held between the string protecting casing and the string hole.

The foregoing objectives of the present invention are attained by an improved game racket having a head frame provided with a plurality of first string holes and second string holes, which are spaced at an appropriate interval for stringing the game racket head. The head frame is provided in the outer edge thereof with a plurality of string protecting casings, each of which has a body portion and a plurality of guide tubes which can be inserted into the corresponding first string holes or second string holes. Some of the string protecting casings are provided with a locating hole which is located centrally between the two guide tubes. The head frame is further provided with a plurality of guide blocks located respectively at the outer side of the string protecting casing and between two adjoining guide tubes. The guide blocks are provided respectively with a locating column corresponding in location to and engageable securely with the locating hole of the string protecting casing.

DETAILED DESCRIPTION OF THE INVENTION

Figure 1:
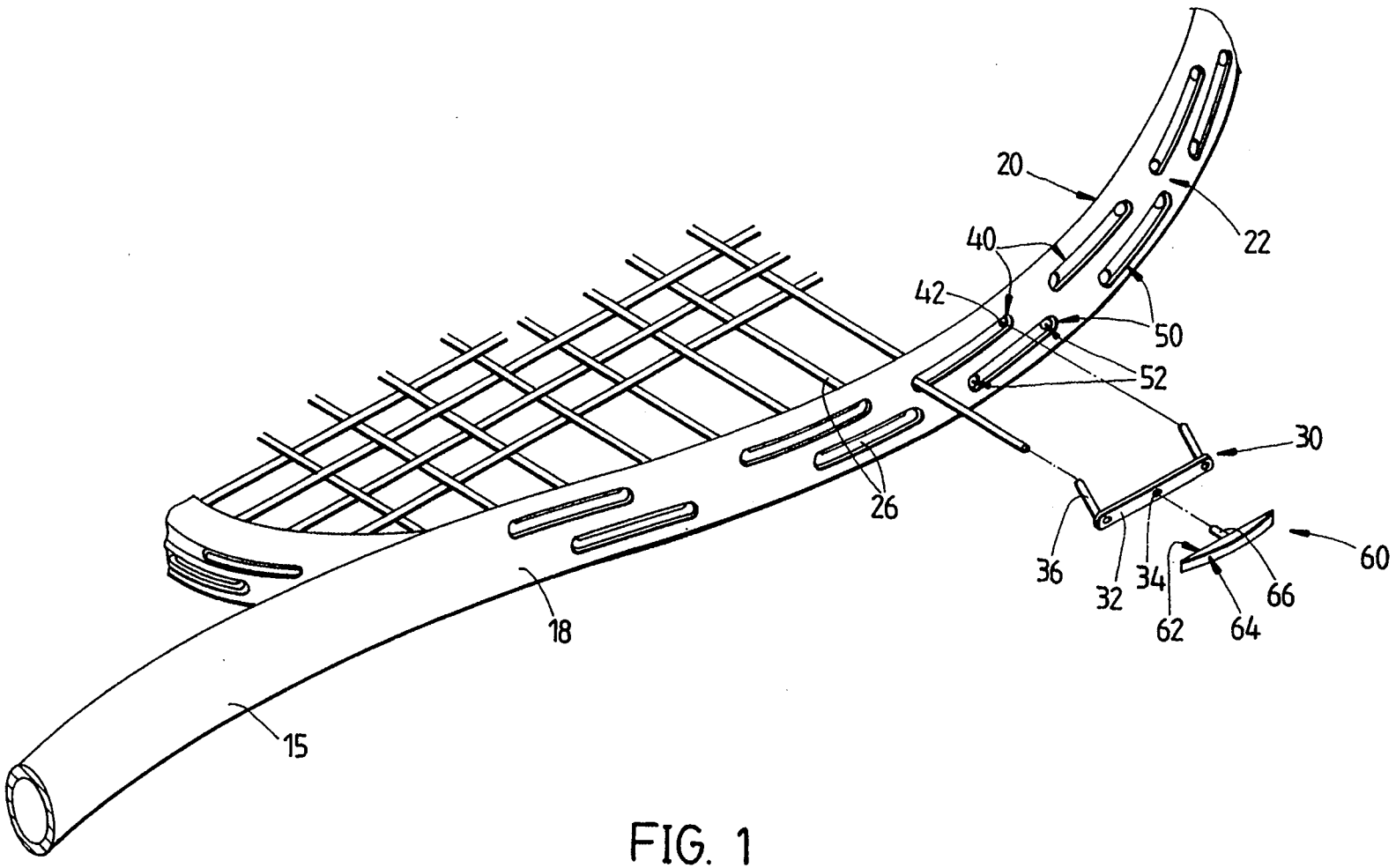
FIG. 1 shows a perspective view of a first preferred embodiment of the present invention.
Figure 2:
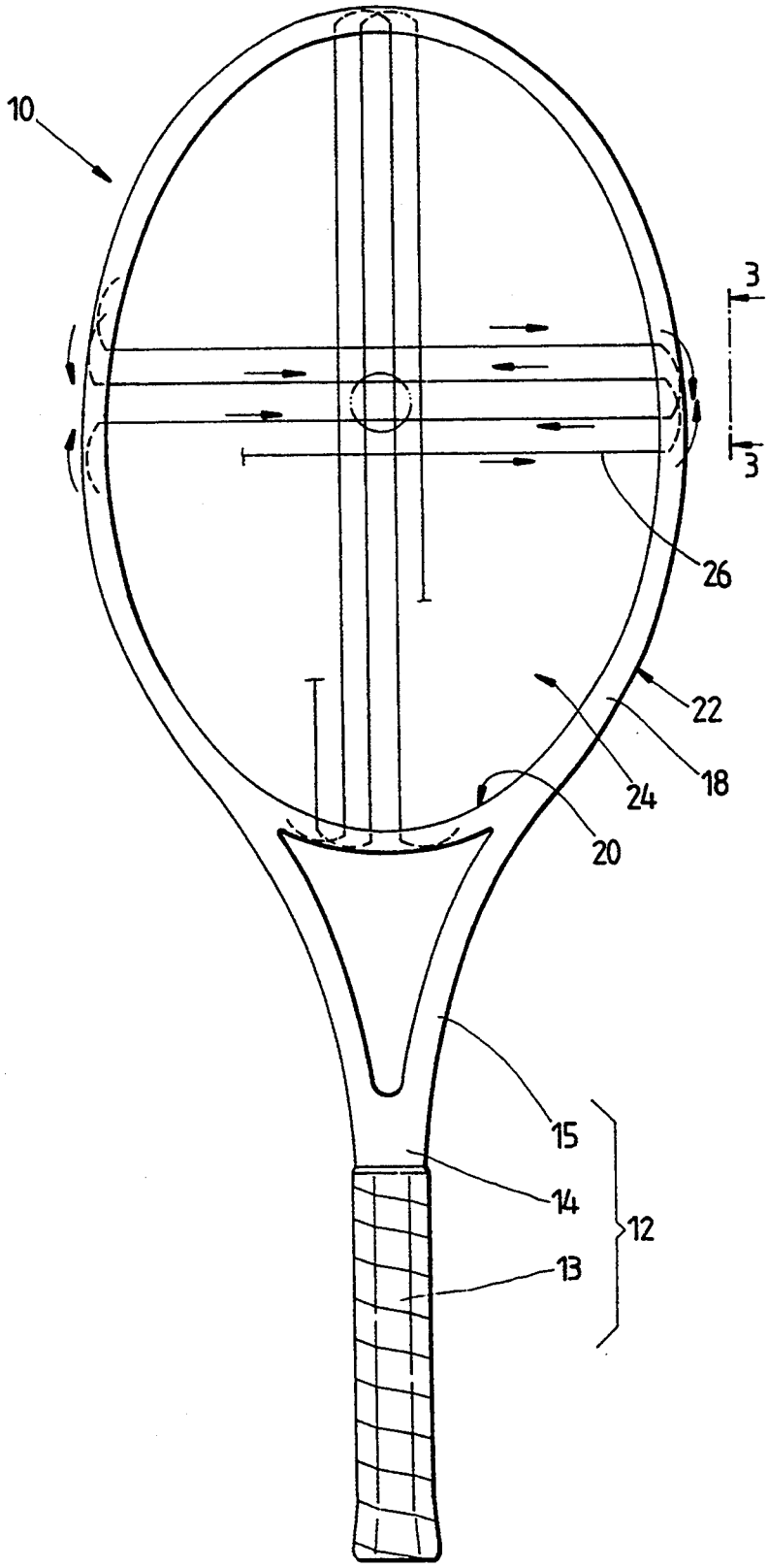
FIG. 2 shows a front elevational view of the first preferred embodiment of the present invention.
Figure 3:
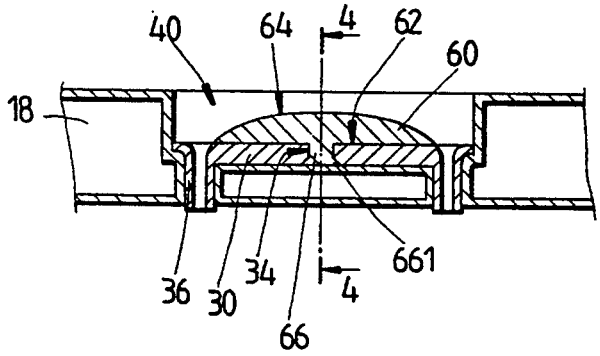
FIG. 3 shows a sectional view of a portion taken along the line 3—3 as shown in FIG. 2.
Figure 4:
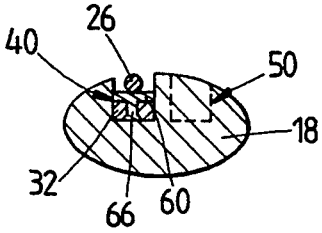
FIG. 4 shows a sectional view of a portion taken along the line 4—4 as shown in FIG. 3.

As shown in FIGS. 1–4, a game racket 10 of the first preferred embodiment of the present invention is made of a wood, metal or plastic composite material and is composed of a handle 12, a grip 13, a shaft 14, a throat 15, and a head frame 18 connected with the throat 15. The head frame 18 is coplanar with the handle 12 and is provided with an outer surface 22 and an inner surface 20 defining a circular face 24.

The outer surface 22 of the head frame 18 is provided with a pulrality of string protecting casings 30 for stringing the circular face 24 with two strings 26.

The outer surface 22 is provided with a plurality of first string receiving slots 40 located at an interval in an abstract planar surface of the outer surface 22 and relative to the upper portion of the circular face 24. Located at an interval in another abstract planar surface relative to the lower portion of the circular face 24 are a plurality of second string receiving slots 50. The first string receiving slots 40 are provided respectively with two first string holes 42 which are located at both ends thereof. Each of the two first string holes 42 is corresponding in location to the center of the second string receiving slot 50 which is provided with two second string holes 52 located at both ends thereof such that the two string holes 52 are in communication with the bottom of the second string receiving slot 50 and the inner surface 20.

Each string protecting casing 30 is disposed in the first and the second string receiving slots 40 and 50 and is provided with a body portion 32, a locating hole 34, and a guide tube 36 extending downwards from the body portion 32 to engage the first hole 42 or the second string hole 52.

The circular face 24 is strung by means of the two strings 26, which are interwoven in such a manner that the two strings 26 are respectively parallel to the longitudinal axis and the short axis of the head frame 18.

A plurality of rigid guide blocks 60 of an aluminium material are provided. Each of the guide blocks 60 is dimensioned to fit into the first string receiving slot 40 or the second string receiving slot 50. The construction of each guide block 60 is such that the guide block 60 is provided with a straight inner surface 62, an arcuate outer surface 64, and a locating column 66 formed integrally at the center of the straight inner surface 62. The locating column 66 of a predetermined length is formed such that it extends in a direction perpendicular to the straight inner surface 62. The length of the locating column 66 is smaller than the thickness of the string protecting casing 30. The locating column 66 is engageable with the locating hole 34 of the string protecting casing 30. The locating coulumn 66 is provided at one end thereof with a circular edge 661 which can be caused to expand by an impact so as to hold the guide block 60 securely in the locating hole 34. In other words, the string protecting casing 30 and the guide block 60 are held securely together such that they can not be caused to become disengaged with each other even when the circular face 24 of the head frame 18 is strung or when the string 26 of the strung circular face (ball-striking face) is impacted severely by a ball. In addition, the string 26 is in contact with the arcuate outer surface 64 of the guide block 60, thereby enabling the string 26 to expand when the ball-striking face 24 of the head frame 18 is impacted by a ball. In other words, the strings 26 which are not hit directly by the ball are also actuated to expand, thereby prolonging the dwelling time of the ball.

Figure 5:
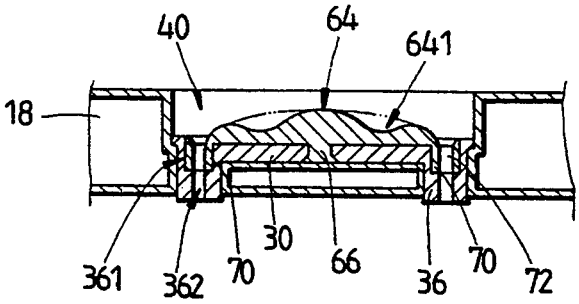
FIG. 5 shows a longitudinal sectional view of a guide block of a second preferred embodiment of the present invention.

As shown in FIG. 5, the guide block 60 of the second preferred embodiment of the present invention is provided with a recessed area 641 and a corrugated outer surface 64. As a result, the contact area between the string 26 and the corrugated outer surface 64 is reduced when the string 26 is put through the outer side of the guide block 60. Upon being impacted by a ball, the string 26 can therefore slide on the outer side of the guide block 60.

The guide block 60 may be provided integrally with two extension portions 70 of a tubular construction and extending in a direction perpendicular to the straight inner surface 62. The two extension portions 70 are engageable with the two guide tubes of the string protecting casing 30. The guide block 60 can be therefore secured to the outer side of the string protecting casing 30.

The extension portions 70 are provided respectively with an axial hole 72 having an trumpetlike portion adjacent to the outer surface 64, thereby enabling the string 26 to be received smoothly in each of the extension portions 70, the guide tube 36, and the first string hole 42 or the second string hole 52.

Figure 6:
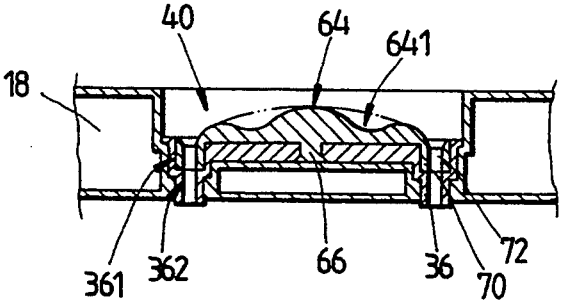
FIG. 6 shows a longitudinal sectional view of a guide block of a third preferred embodiment of the present invention.

As shown in FIG. 6, the string protecting casing 30 of the third preferred embodiment of the present invention is intended for use in conjunction with the guide block 60 of the second preferred embodiment of the present invention as shown in FIG. 5, and is provided in the guide tube 36 thereof with a large diameter portion 361 and a small diameter portion 362 coaxial with the large diameter portion 361, which is connected at one end thereof with the body portion 32 of the string protecting casing 30 and is connected at another end thereof with the small diameter portion 362. The large diameter portion 361 is so dimensioned as to receive therein the extension portion 70. The small diameter portion 362 has an inner diameter slightly larger than the diameter of the string 26 so that the string 26 can be properly guided in the small diameter portion 362.

Figure 7:
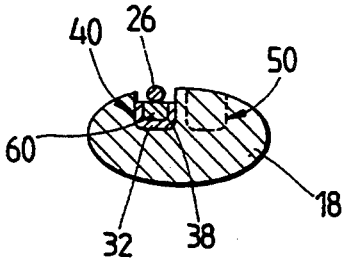
FIG. 7 shows a cross sectional view of a guide block of a fourth preferred embodiment of the present invention.

As illustrated in FIG. 7, the body portion 32 of the string protecting casing 30 of the fourth preferred embodiment of the present invention is provided respectively on both sides of the longitudinal axis thereof with a baffle 38 extending outwards. These two baffles 38 of the body portion 32 are parallel to each other and spaced at an interval large enough to hold securely therein the guide block 60. As a result, the locating column 66 is eliminated.

In addition, it is suggested that the locating hole 34 of the body portion 32 of the string protecting casing 30 and the locating column 66 of the guide block 60 are interchangeable in location. In other words, the body portion 32 of the string protecting casing 30 is provided integrally with a locating column while the guide block is provided centrally with a locating hole. Moreover, the first string receiving slots 40 located in one abstract planar surface and the second string-receiving slots 50 located in another abstract planar surface may be extended at both adjoining ends thereof in the directions along the longitudinal axes thereof such that the adjoining ends are connected.

What is claimed is:

1. A game racket comprising:

a handle;

a head frame connected with one end of said handle and provided with an outer surface and an inner surface defining a circular face of said head frame, said outer surface and said inner surface provided respectively with first string holes and second string holes, which are located in different abstract planes;

at least a string passing through said first string holes and said second string holes to form a ball-hitting face in said circular face; and a plurality of string protecting casings fastened to said outer surface of said head frame and provided respectively with a body portion and a plurality of guide tubes engageable with said first string holes or said second string holes;

wherein at least some of said string protecting casings are provided centrally between two of said guide tubes with a locating hole;

wherein said string protecting casings are provided respectively with a guide block located between two adjoining guide tubes, said guide block having an arcuate outer surface and a straight inner surface provided integrally with a locating column engageable with said locating hole.

2. The game racket as defined in claim 1, wherein said guide block is provided with a corrugated outer surface.

3. The game racket as defined in claim 1, wherein said guide block is provided respectively at both ends thereof with an extension portion of a tubular construction and engageable with said guide tubes.

4. The game racket as defined in claim 3, wherein said extension portion has an axial hole provided with one end which is adjacent to said outer surface of said guide block and which has an inner diameter greater than an inner diameter of the rest of said axial hole.

5. The game racket as defined in claim 3, wherein said guide tubes are provided respectively with a large diameter portion and a small diameter portion coaxial with said large diameter portion which is connected at one end thereof with said body portion of said string protecting casing and is dimensioned to receive therein said guide tube, said small diameter portion having an inner diameter dimensioned to receive therein said string.

6. The game racket as defined in claim 1, wherein said body portion of said string protecting casing is provided with two baffles which are parallel to each other and which extend in the direction of a longitudinal axis of said body portion, said two baffles being separated by an interval large enough to hold therein said guide block.

7. The game racket as defined in claim 1, wherein said outer surface of said head frame is provided with a plurality of first string receiving slots and second string receiving slots, each of said first string receiving slots provided with two first string holes, each of said second string receiving slots provided with two second string holes.

8. The game racket as defined in claim 3, wherein said outer surface of said head frame is provided with a plurality of first string receiving slots and second string receiving slots, each of said first string receiving slots provided with two first string holes, each of said second string receiving slots provided with two second string holes.

9. The game racket as defined in claim 6, wherein said outer surface of said head frame is provided with a plurality of first string receiving slots and second string receiving slots, each of said first string receiving slots provided with two first string holes, each of said second string receiving slots provided with two second string holes.

10. The game racket as defined in claim 7, wherein two of said first string receiving slots or said second string receiving slots, which are located on the same abstract plane and are adjacent to each other, are connected with each other by adjoining ends thereof.

* * * * *